US007294093B2

(12) United States Patent
Stafiej et al.

(10) Patent No.: US 7,294,093 B2
(45) Date of Patent: Nov. 13, 2007

(54) SKI EXERCISING AND REHABILITATION APPARATUS

(75) Inventors: Andrzej Stafiej, Sanok (PL); Ireneusz Rabczak, Sanok (PL); Jan Szostak, Sanok (PL)

(73) Assignee: Ireneusz Rabczak (PL)

( * ) Notice: Subject to any disclaimer, the term of this patent is extended or adjusted under 35 U.S.C. 154(b) by 514 days.

(21) Appl. No.: 10/470,703

(22) PCT Filed: Jan. 31, 2002

(86) PCT No.: PCT/PL02/00008

§ 371 (c)(1),
(2), (4) Date: Jul. 30, 2003

(87) PCT Pub. No.: WO02/060544

PCT Pub. Date: Aug. 8, 2002

(65) Prior Publication Data

US 2004/0067823 A1 Apr. 8, 2004

(51) Int. Cl.
*A63B 22/02* (2006.01)

(52) U.S. Cl. ..... 482/54; 482/51

(58) Field of Classification Search ..... 482/51, 482/52, 70, 71, 54; 434/253
See application file for complete search history.

(56) References Cited

U.S. PATENT DOCUMENTS 3,408,067 A * 10/1968 Armstrong ..... 482/30
3,642,279 A * 2/1972 Cutter ..... 482/54
4,993,704 A * 2/1991 Luczynski ..... 482/70
5,162,029 A * 11/1992 Gerard ..... 482/71
5,897,461 A * 4/1999 Socwell ..... 482/54

* cited by examiner

*Primary Examiner*—Jerome Donnelly
(74) *Attorney, Agent, or Firm*—John A. Merecki; Hoffman, Warnick & D'Alessandro LLC

(57) ABSTRACT

The object of this invention is an the apparatus for ski exercising and rehabilitation, intended to serve for both beginning and professional skiers who shall later ski on snow on either carving or traditional skis, water skis or snowboards. The apparatus according to the invention has upper drive roll (11) and, below, lower drive roll (13) and rotatable glide rolls (12) in between them, all arranged on arc (b) in slanted side beams (4), (5) of frame (a), said arc being formed by contact points of the inner side of endless downhill run strip (14) in form of mat, with 2.4 cm high stiff-and-springing bristle, with rotatable glide rolls (12), lower drive roll (13) and upper drive roll (11), whereas contact point (A) of said endless downhill run strip (14) and said upper drive roll (11) is in its highest point, whereas straight line (c) joining contact point (A) and contact point (B) of said endless downhill run strip (14) with said lower drive roll (13) and line (f) perpendicular to (c) through point (D) as the outermost point on said arc (b), create distance (d) of 2 cm to 5 cm.

6 Claims, 3 Drawing Sheets

SKI EXERCISING AND REHABILITATION APPARATUS

BACKGROUND OF THE INVENTION

1. Field of the Invention

The object of this invention is the apparatus for ski exercising and rehabilitation, intended to serve for both beginning and professional skiers who shall later ski on snow on either carving or traditional skis, water skis or snowboards. The apparatus serves also for rehabilitation.

2. Description of the Prior Art

The ski exercising apparatus known from the Polish patent application No. 315277 is equipped with a run deck, located above the base frame, rotatably attached to both by means of drive levers. The deck has an element which stimulates a free motion of skis, main element holding the skis, ski holders with moving pivots, rows of track rolls located under drive shafts, stationary elastic bristled mat. At least one elastic element is mounted eccentrically on the base frame.

A drawback of this solution is its one-sided single-purpose usefulness. There is no possibility to use it with various ski equipment types, for rehabilitation and, what is most important, to use it by beginners, especially children, because the springing element stimulating free movement of skis restricts the free movement with skis and enforces constant concentration of the trainee in commanding the skis.

The objective of this invention is to design an apparatus, which shall serve for ski exercising of any of the five types of skis, as well as for the rehabilitation of many human organs.

BRIEF SUMMARY OF THE INVENTION

The essence of the invention consists in that the apparatus having a upper drive roll and lower drive roll below, with rotatable glide roles between them, all arranged in an arc in arched and slanted side frame beams, formed by contact points of the inner side of the endless slidable downhill-run strip, in form of mat with 2–4 cm high stiff and springing bristle, and the upper drive roll, whereas the straight line between the contact point A and the contact point B of the inner side of the downhill strip with the lower drive roll and the perpendicular line through the point D as the outermost point of the arc, form a 4 cm long distance, whereas the support sticks, mounted in the stationary strip, have their grip handles situated over the movable downhill-run strip.

The stationary strip is preferably located below the lower drive roll. The support sticks have preferably the arc shape, below their grip handles, with arc convexity outward of the frame outline.

The advantages of the invention comprise its universality of application for carving-, downhill-, cross-country, water skis and snowboard exercising. It may also be applied by advanced ski trainees, as well as by beginners who wish to learn skiing. Besides, the apparatus may be used for the physical joint mobility rehabilitation, massage of feet through acting on receptors in feet sole, stimulation of blood circulation, as well as cross-country skiing exercise at two different upwards and downwards slopes, In downhill skiing exercise option the apparatus perfects the skier's fitness specifically needed for 'alpine', downhill skiing.

BRIEF DESCRIPTION OF THE SEVERAL VIEWS OF THE DRAWINGS

The invention is presented as the example of embodiment in figures, where.

DETAILED DESCRIPTION OF THE INVENTION

Figure 1:
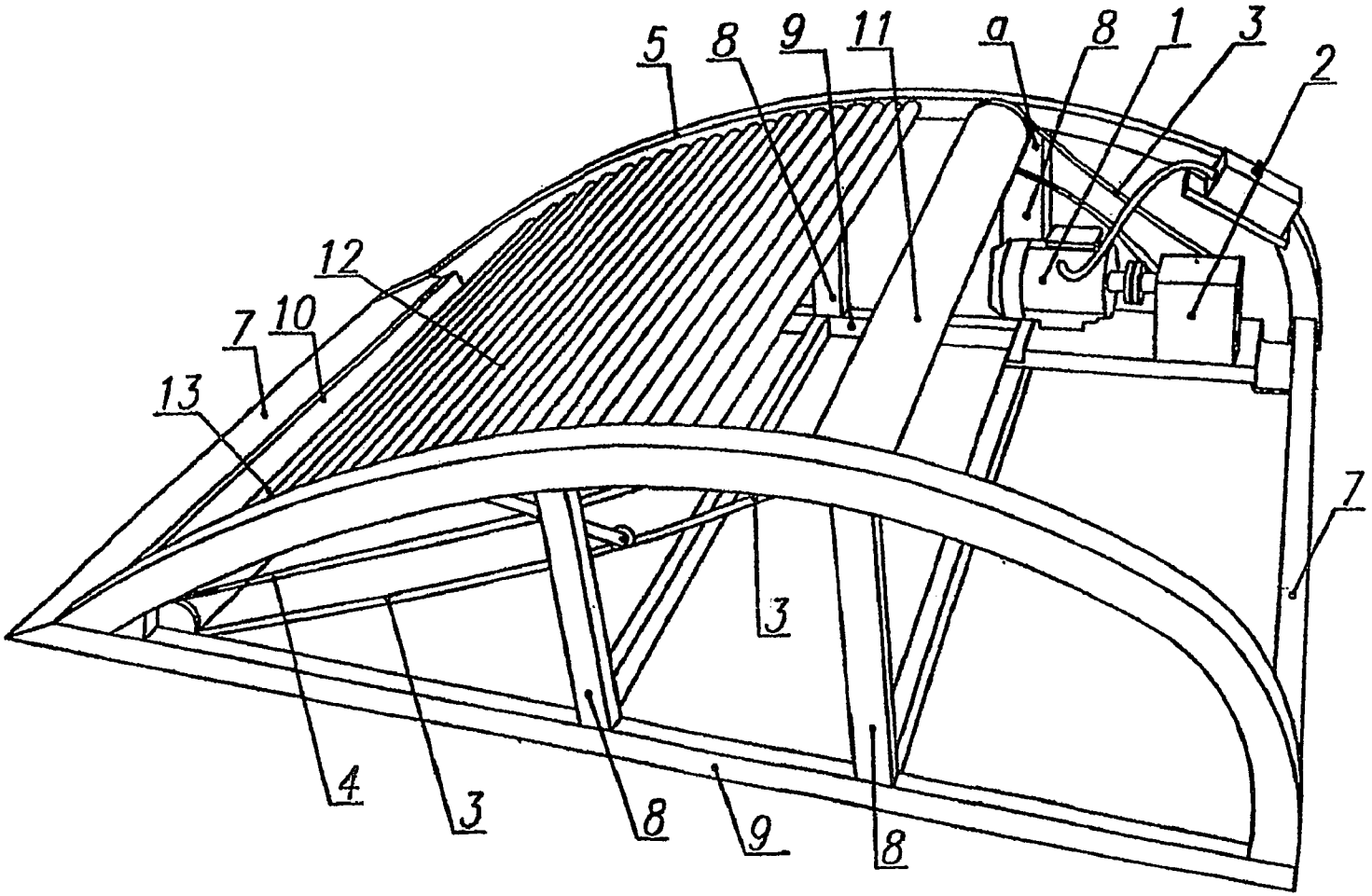
FIG. 1 is the axonometric projection of the frame skeleton of the apparatus including its drive unit.
Figure 2:
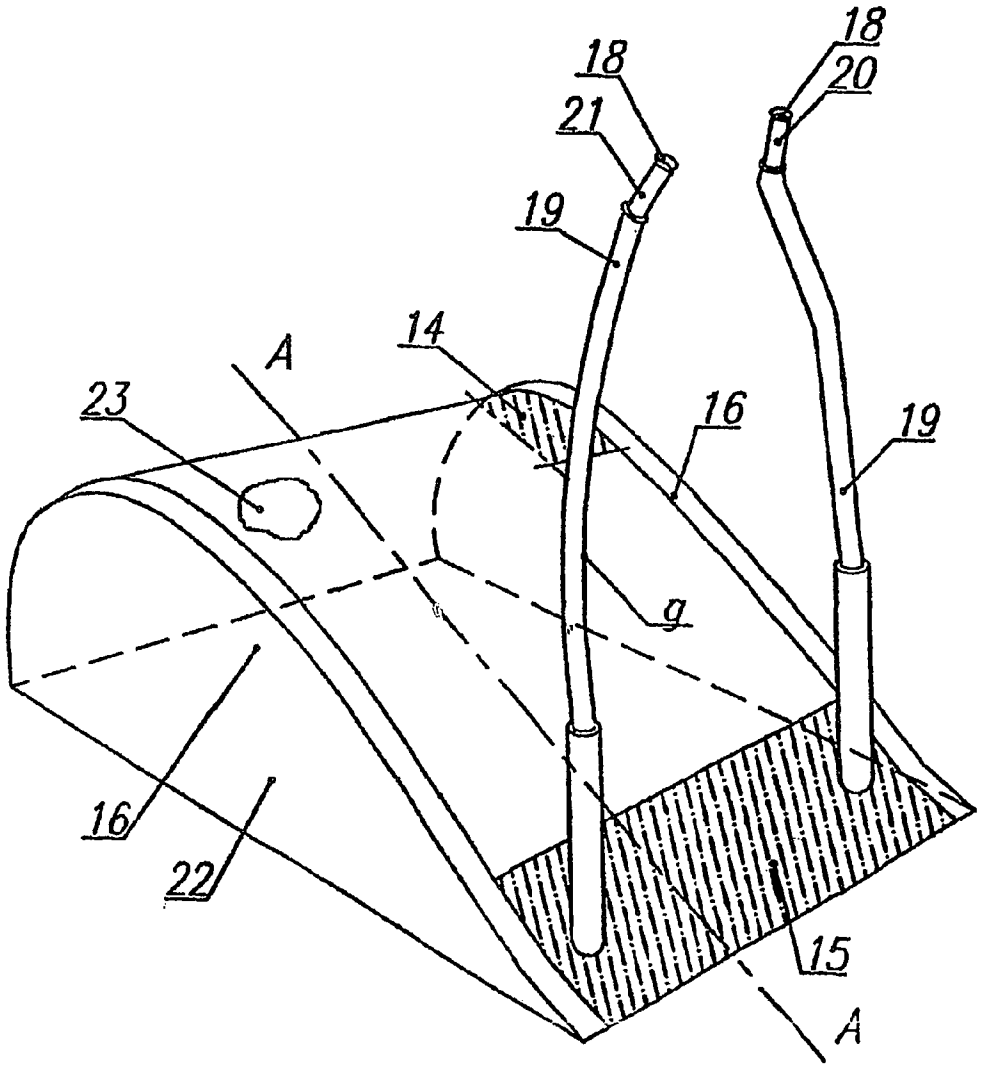
FIG. 2 shows the apparatus with support sticks, including a sector of the downhill run strip, stationary strip, and a sector of cover.
Figure 3:
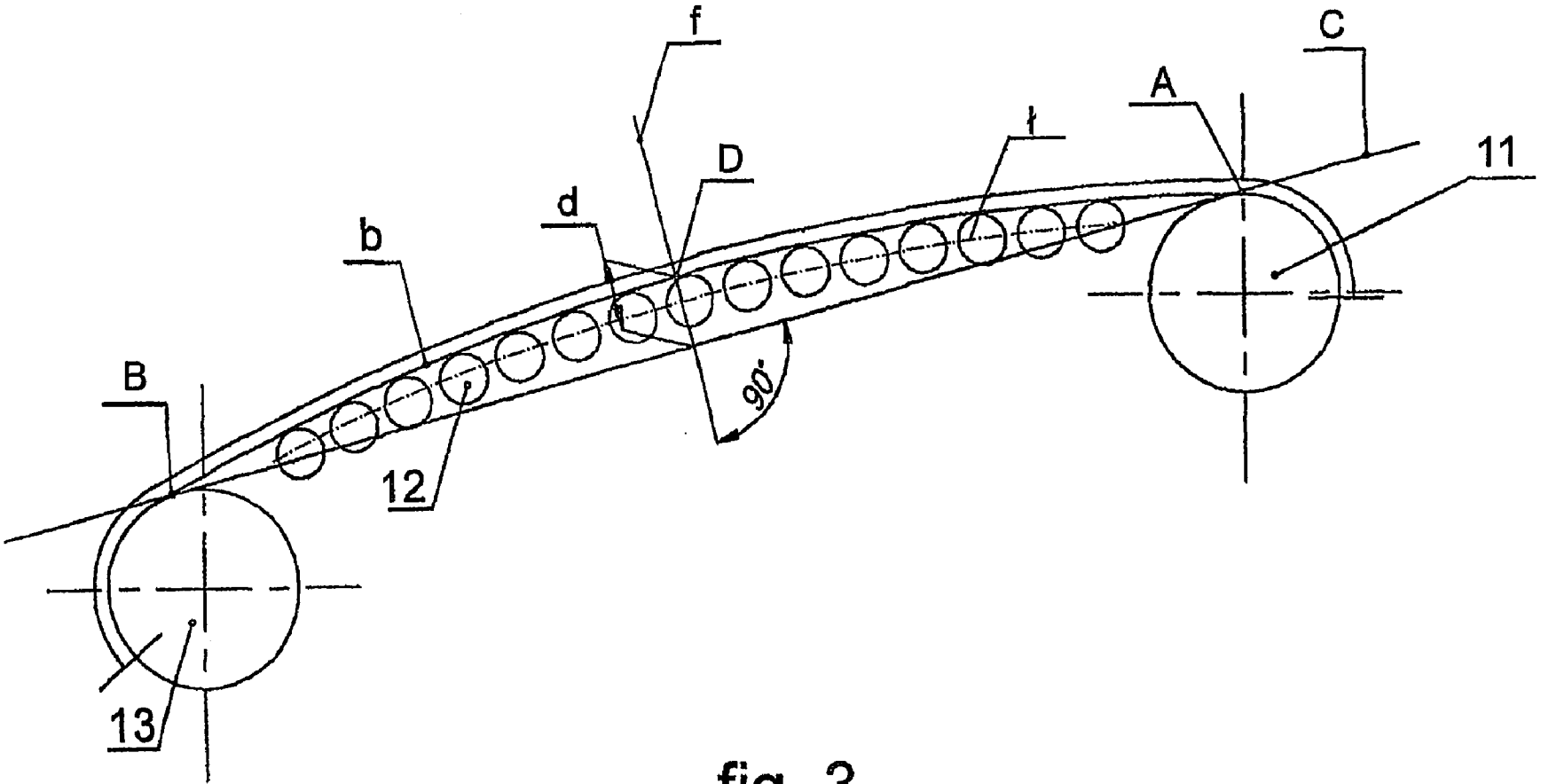
FIG. 3 is a cross section along the A—A line from FIG. 2.

The ski exercising and rehabilitation apparatus consists of the drive motor 1, reducing gear 2, belt transmission 3 and frame a in form of a skeleton. The skeleton outlines are formed by the upper arched and slanted side frame beams 4, 5 with their arcs upward, bottom cross bars 7, supportive vertical beams 8 and bottom side beams 9. There is a cross bar 10 below the lower drive roll 13. The upper side beams 4, 5 provide rotatable mounting for upper drive roll 11 and the lower drive roll 13, and for the rotatable glides roles 12 between them, arranged along the arc b in the upper side beams 4, 5, the arc b being formed by contact points of the inner side of the endless downhill run strip 14, in form of mat with 3-cm, high stiff and springing bristle, with the rotatable glide roles 12, upper drive roll 11 and lower drive roll 13. The contact point A of the endless downhill run strip 14 and the upper drive roll 11 is in its highest point, whereas the straight line c joining contact point A and contact point B of the endless downhill run strip 14 with the lower drive roll 13 and the line f, perpendicular to c through point D as the outermost point on the arc b, create the distance d of 4 cm. The support sticks 19 are mounted on the stationary strip 15 or on the cover 23. Their grip handles 20, 21 are situated over the movable downhill-run strip 14. Below their grip handles 20, 21, the support sticks 19 have an arc shape with its convexity outward of the outline of the frame a and its range extending so as to accommodate the body of a trainee. The grip handles 20, 21 are provided with ON/OFF switches 18. The stationary strip 15 is located below the lower drive roll 13 and is fixed to the bottom cross bar 10. A cover strip 16 on upper side frame beams 4, 5 is made of grass-like mat. The skeleton of the frame a has covers 22 at both sides and the guard 23 as its front finish.

The downhill-run structure in this apparatus is adjustably movable and the skier stands in one place while the downhill run of pre-set slope moves with a pre-set speed.

The apparatus functions as follows: downward pointing skis with the trainee are on the movable downhill-run strip 14. The trainee uses the ON/OFF switches 18 to start the drive motor 1, which drives the upper drive roll 11 through reduction gear 2 and belt transmission 3. The upper drive roll 11 drives the lower drive roll 13 through the other belt transmission 3. Both drive rolls drive the movable downhill-run strip 14 which glides over the rotatable glide rolls 12, and then the trainee, holding the grip handles 20, 21 of support sticks 19, begins exercising while performing any motions, as are done during downhill skiing. Using various types of skis, the trainee may perform various manoeuvres. Without skis, the trainee may run upward or downward, in shoes or without, and perform various rehabilitation tasks. The trainee may switch off the motor and stop the movement of the downhill run strip 14. For beginners, especially children a horizontal support bar may be fixed between the support sticks 19. The trainee, while holding (to) it, may concentrate on arranging and lifting of skis, thus getting accustomed to downhill skiing. The apparatus may be used for training of water skiers. For that the motor 1 is run in a reverse sense of rotation and the downhill-run strip 14 moves in reverse direction, while the support sticks 19 are mounted on cover 23.

What is claimed is:

1. A ski-exercising and rehabilitation apparatus comprising:

a. a drive motor;

b. a frame having a rectilinear base having two sides and a forward end and a rearward end and two side members each attached to the base at first and second attachment points proximate to the forward and rearward ends of the base respectively, the side members each defining a convex arcuate upper profile from the first end to an apex;

c. an upper drive roller connected to each side member about a first axis joining the apex of each side member and adapted to be driven rotatably thereabout by the drive motor;

d. a lower drive roller connected to each side member about a second axis joining each side member along a point equidistant along the upper profile and proximate to the first attachment point and adapted to be driven rotatably thereabout by the drive motor in the same direction as the upper drive roller;

e. a plurality of freely rotatable rollers extending between corresponding points of the upper profile of each side member between the upper and lower drive members;

f. an endless material loop surrounding the upper and lower drive rollers and the freely rotatable rollers;

g. a covering extending between corresponding portions of the upper profile of each side member beyond the endless material loop; and h. a pair of support sticks extending substantially uprightly from the cover, each support stick having a handle positioned over the endless material loop;

wherein the upper profile has a maximum perpendicular extension beyond a line connecting the apex and the first attachment point of between 2 and 5 cm.

2. The ski-exercising and rehabilitation apparatus according to claim 1, wherein the covering extends below the lower drive roller.

3. The ski-exercising and rehabilitation apparatus according to claim 1, wherein the support sticks extend from the covering convexly outward from the frame below the handles thereof.

4. A ski-exercising and rehabilitation apparatus having a drive motor, a reduction gear, a belt transmission, a frame and ON/OFF switches on support sticks, wherein said apparatus has an upper drive roll and a lower drive roll below it as well as rotatable glide rolls in between them, characterized in that all the rotatable glide rolls are arranged along an arc in slanted side beams, of the frame, said arc being formed by contact points between the inner side of an endless downhill run strip in the form of a mat, with 2 to 4 cm high, stiff and springing bristles, and the rotatable glide rolls, for the lower drive roll and the upper drive roll, wherein a first contact point between said endless downhill run strip and said upper drive roll is at the highest point of said upper drive roll, and wherein the straight line joins the first contact point and a second contact point between said endless downhill run strip and said lower drive roll, and wherein a second line runs perpendicular to the straight line and passes through an outermost point on the arc, creating a distance of 2 cm to 5 cm between the outermost point and the intersection of the second lines and the straight line, and wherein a stationary strip or cover serves to mount support sticks having grip handles and situated over said movable downhill run strip.

5. The apparatus according to claim 4, wherein said stationary strip is located below the lower drive roll.

6. The apparatus according to claim 4, wherein said support sticks have an arced shape, with its convexity outward of the outline of said frame a below said grip handles.

* * * * *